US011530814B2

(12) United States Patent
O'Donnell

(10) Patent No.: US 11,530,814 B2
(45) Date of Patent: Dec. 20, 2022

(54) ADJUSTABLE RESTRICTOR FOR BURNER

(71) Applicant: BECKETT THERMAL SOLUTIONS, North Ridgeville, OH (US)

(72) Inventor: Michael J. O'Donnell, Avon, OH (US)

(73) Assignee: BECKETT GAS, INC., North Ridgeville, OH (US)

( * ) Notice: Subject to any disclaimer, the term of this patent is extended or adjusted under 35 U.S.C. 154(b) by 157 days.

(21) Appl. No.: 16/484,169

(22) PCT Filed: Mar. 12, 2018

(86) PCT No.: PCT/US2018/022000

§ 371 (c)(1),
(2) Date: Aug. 7, 2019

(87) PCT Pub. No.: WO2018/165660

PCT Pub. Date: Sep. 13, 2018

(65) Prior Publication Data

US 2020/0025369 A1 Jan. 23, 2020

Related U.S. Application Data

(60) Provisional application No. 62/469,553, filed on Mar. 10, 2017.

(51) Int. Cl.

| | |
|---|---|
| ***F23D 14/02*** | (2006.01) |
| ***F23D 14/60*** | (2006.01) |
| *F23L 13/02* | (2006.01) |
| *F23N 1/02* | (2006.01) |

(52) U.S. Cl.
CPC ..... *F23D 14/02* (2013.01); *F23D 14/60* (2013.01); *F23L 13/02* (2013.01); *F23N 1/02* (2013.01); *F23N 2235/04* (2020.01); *F23N 2235/10* (2020.01)

(58) Field of Classification Search
CPC .... F23N 2235/04; F23N 2235/10; F23N 1/02; F23L 13/02; F23D 14/02; F24F 13/1426
USPC ..... 431/354, 177
See application file for complete search history.

(56) References Cited

U.S. PATENT DOCUMENTS

| | | | | |
|---|---|---|---|---|
| 2,799,288 A * | 7/1957 | Knight | F23D 14/60 137/98 |
| 3,143,132 A | 8/1964 | Pangburn | |
| 3,227,202 A * | 1/1966 | Morgan | F23D 14/36 431/185 |

(Continued)

FOREIGN PATENT DOCUMENTS

| | | |
|---|---|---|
| CN | 2628881 Y | 7/2004 |
| CN | 203907683 U | 10/2014 |

(Continued)

*Primary Examiner* — Avinash A Savani
(74) *Attorney, Agent, or Firm* — Tarolli, Sundheim, Covell & Tummino LLP

(57) ABSTRACT

A flow control device for an appliance including a burner and a blower for delivering a pre-mixed mixture of air and gas to the burner includes a flange defining an opening through which the pre-mixed mixture of air and gas flows from an outlet of the blower to the burner. A damper plate is provided in the opening downstream of the blower for increasing a static pressure at the outlet of the blower during ignition of the burner.

21 Claims, 5 Drawing Sheets

(56) References Cited

U.S. PATENT DOCUMENTS

| | | | | |
|---|---|---|---|---|
| 4,257,762 | A * | 3/1981 | Zink | F23D 14/34 431/177 |
| 4,856,981 | A * | 8/1989 | Flanagan | F23C 15/00 431/1 |
| 5,096,156 | A * | 3/1992 | Wylie | B60H 1/00678 251/129.11 |
| 5,406,840 | A | 4/1995 | Boucher | |
| 5,876,015 | A * | 3/1999 | Schaeffer | F16K 1/222 251/305 |
| 6,364,211 | B1 * | 4/2002 | Saleh | F24F 13/1426 236/49.3 |
| 2004/0058639 | A1 * | 3/2004 | Perrin | F24F 13/1406 454/369 |
| 2007/0044787 | A1 * | 3/2007 | Brice | F23L 13/02 126/91 A |
| 2010/0310998 | A1 | 9/2010 | Raleigh et al. | |
| 2013/0284115 | A1 * | 10/2013 | Kim | F23N 1/022 122/14.21 |
| 2014/0199643 | A1 | 7/2014 | Smelcer | |
| 2014/0202443 | A1 * | 7/2014 | Sherrow | F23D 14/62 126/116 R |
| 2015/0354809 | A1 | 12/2015 | Doura et al. | |
| 2017/0292697 | A1 * | 10/2017 | Shimazu | F23N 3/085 |

FOREIGN PATENT DOCUMENTS

| | | | |
|---|---|---|---|
| CN | 204114841 | U | 1/2015 |
| CN | 206310490 | U | 7/2017 |
| CN | 206669741 | U | 11/2017 |
| DE | 4408801 | A1 | 9/1994 |
| WO | 2015146426 | | 10/2015 |

* cited by examiner

ADJUSTABLE RESTRICTOR FOR BURNER

CROSS REFERENCES TO RELATED APPLICATIONS

This application filed under 35 U. S. C. § 371 is a national phase application of International Application Serial Number PCT/US2018/022000 filed Mar. 12, 2018 which claims priority to U.S. Provisional Application 62/469,553, filed Mar. 10, 2017.

TECHNICAL FIELD

The present invention relates generally to burner systems and, in particular, relates to a variable flow control device for reducing burner ignition noise.

BACKGROUND

Pre-mixed burners have a tendency to have "rough" or "hard" ignitions, especially in compact, high efficiency appliances, e.g., water heaters. This can be due to a number of factors, but primarily from an accumulation of the gas air mixture that lights and rapidly expands upon ignition. The combustion chambers in these appliances are typically small and somewhat flow restrictive in order to achieve sufficient heat transfer. That said, the rapidly expanding combustion within the combustion chamber causes the chamber pressure to momentarily spike. The pressure spike pushes against the blower delivering the gas/air mixture, thereby causing the gas-air flow into the combustion chamber to momentarily slow or stop. This can often start a series of pressure oscillations that are audible as a rumbling or booming.

Efforts have been made to help minimize or eliminate this elevated ignition noise by modulating the system to a lower input rate at ignition. The way these systems modulate is by turning the blower speed down or restricting the blower inlet to match the air and gas. To this end, providing less gas at ignition will cause less pressure buildup within the chamber. However, reducing the blower discharge pressure can actually make ignitions worse, even at the lower input rate.

SUMMARY

In accordance with an embodiment of the present invention, a flow control device for an appliance having a burner and a blower for delivering a pre-mixed mixture of air and gas to the burner includes a flange defining an opening through which the pre-mixed mixture of air and gas flows from an outlet of the blower to the burner. A damper plate is provided in the opening downstream of the blower for increasing a static pressure at the outlet of the blower during ignition of the burner.

In another aspect, a system for an appliance includes a burner for providing heated combustion products to the appliance. A blower has an outlet for supplying the burner with one of air or a pre-mixed mixture of gas and air. An adjustable damper plate positioned downstream of the burner controls the flow of fluid from the blower to the burner. The adjustable damper plate has a first condition during ignition of the burner for increasing the static pressure at the burner outlet and a second condition after ignition for increasing fluid flow to the burner relative to the first condition.

In another aspect, a flow control device for an appliance having a burner and a blower for delivering air to the burner includes a flange defining an opening through which the air flows from an outlet of the blower to the burner. A damper plate is provided in the opening downstream of the blower for increasing a static pressure at the outlet of the blower during ignition of the burner.

Other objects and advantages and a fuller understanding of the invention will be had from the following detailed description and the accompanying drawings.

DETAILED DESCRIPTION

The present invention relates generally to burner systems and, in particular, relates to a variable restricting device for reducing burner ignition noise. The device of the present invention can be used with any premixed or non-premixed burner for commercial or residential appliances.

Figure 1:
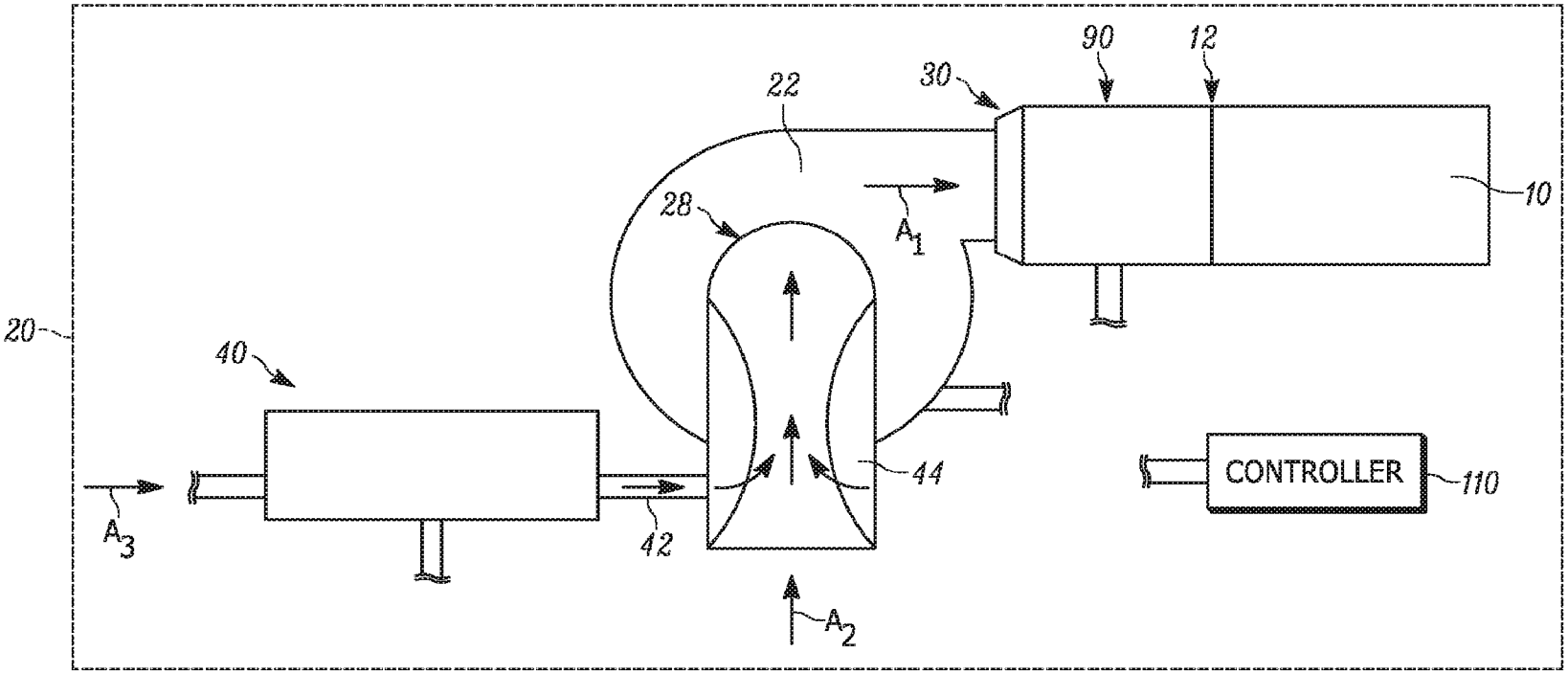
FIG. 1 is a schematic illustration of an appliance with a burner and flow control device in accordance with the present invention.

FIG. 1 illustrates an example burner 10 for an appliance 20 in accordance with the present invention. The appliance 20 can be any residential or commercial appliance, e.g. furnace, water heater, tail less water heater, oven, etc. The burner 10 can be a pre-mixed burner in which a mixture of air and combustible fuel, e.g., gas, is pre-mixed upstream of the burner or otherwise mixed prior to combustion so that no secondary air is needed. For example, the burner 10 can constitute the pre-mixed burner illustrated and described in U.S. Pat. No. 9,528,698, the entirety of which is incorporated by reference herein and provided in the attached Appendix. Alternatively, the burner 10 can be a non-pre-mixed burner in which only a portion of the air is provided as primary an along with the combustible fuel. In this configuration, secondary air is introduced downstream of the burner to complete the combustion process.

In FIG. 1, a blower 22 and fuel valve 40 cooperate to supply a pre-mixed mixture $A_1$ of air $A_2$ and fuel $A_3$, e.g., gas, to the burner 10. The blower 22 includes an inlet or intake opening 28 and a discharge opening 30. The intake opening 28 receives incoming air $A_2$ via suction. The discharge opening 30 is fluidly connected to the burner 10. A controller 110 is electrically connected to the blower 22 for selectively turning the blower off and on at a single, fixed speed. The blower 22 can also be a variable speed type if additional control is desired. It will be appreciated that the fuel valve 40 will be omitted when the burner 10 is not a pre-mixed burner.

A venturi 44 fluidly connects the gas valve 40 to the intake opening 28 of the blower 22. A tube 42 can fluidly connect the gas valve 40 and venturi 44. Alternatively, the gas valve 40 can be directly connected to the venturi 44 (not shown). The controller 110 is connected to the gas valve 40 for controlling operation thereof.

A variable or adjustable flow control device 90 fluidly connects the discharge opening 30 of the blower 22 to the burner 10. The flow control device 90 is therefore downstream of the blower 22 and controls the flow of the air/fuel mixture $A_3$ from the blower to the burner 10. Although the flow control device 90 is illustrated as being a separate component from the blower 22 and burner 10, it will be appreciated that the flow control device can be incorporated into the housing of the blower or the housing of the burner 10 (not shown).

Figure 2:
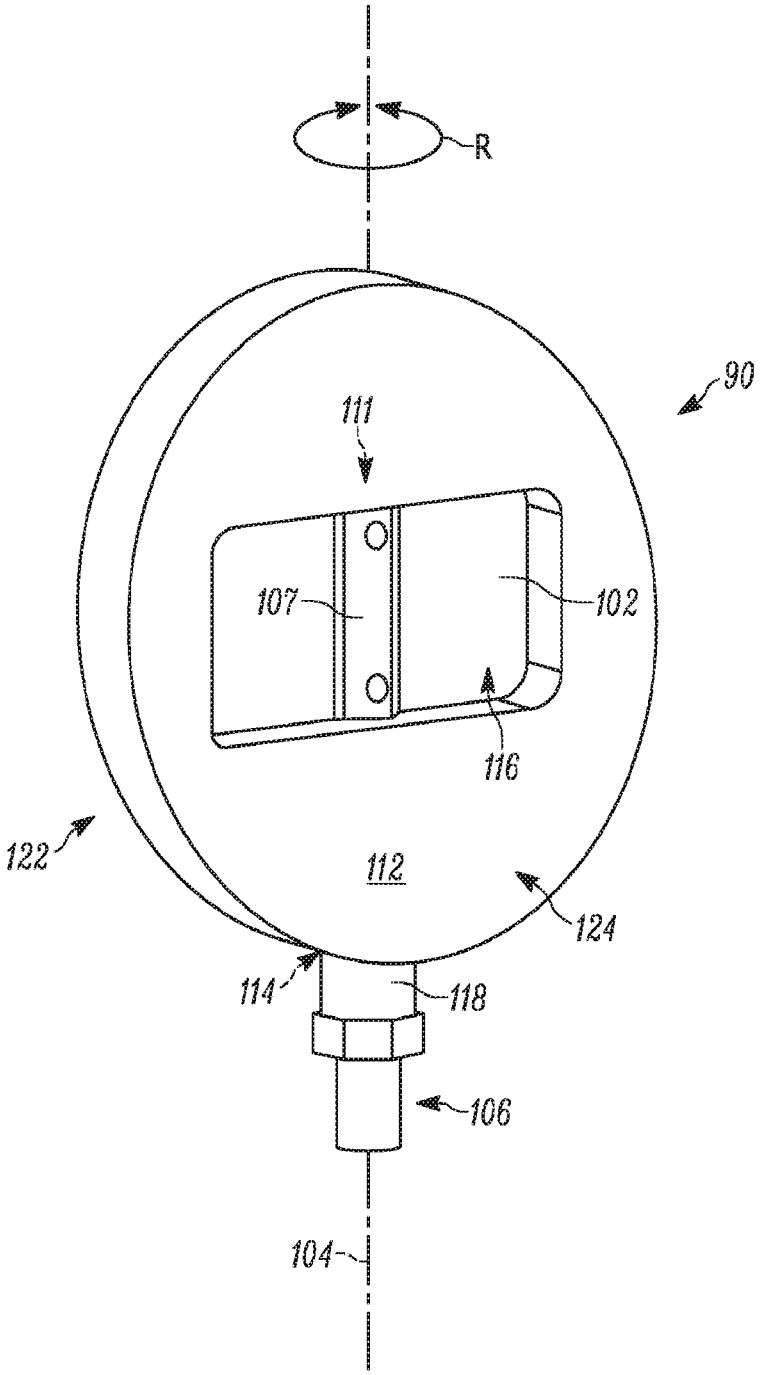
FIG. 2 is a front view of a damper plate of the flow control device of FIG. 1.
Figure 3:
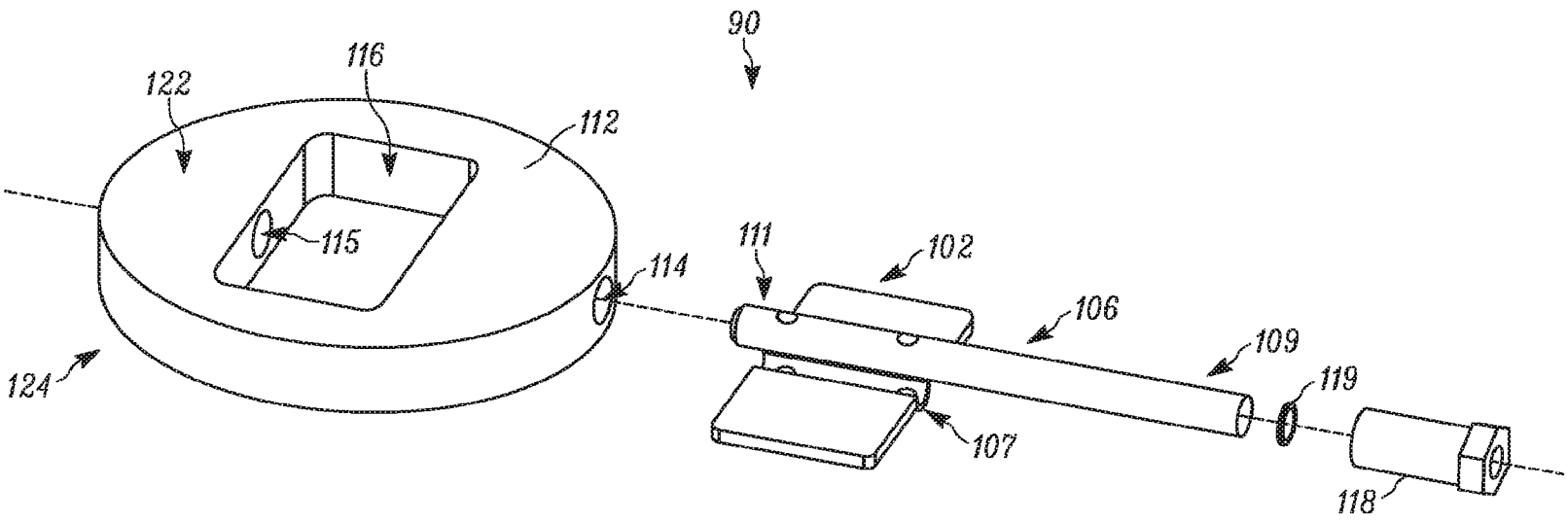
FIG. 3 is an exploded view of the damper of FIG. 1.

Referring to FIGS. 2-3, the flow control device 90 includes a damper plate 102. The damper plate 102 includes a recess 107 for receiving a shaft 106 that extends from a first end 109 to a second end 111. The damper plate 102 and shaft 106 are rigidly fixed together.

The flow control device 90 further includes a tube or flange 112 extending longitudinally from a first end 122 to a second end 124. An opening 116 extends longitudinally entirely through the flange 112. A first passage 114 extends from the periphery of the flange 112 to the opening 116. A second passage 115 extends from the opening 116 towards the periphery of the flange 112. The first and second passages 114, 115 are aligned with one another on opposite sides of the opening 116.

The shaft 106 extends through the passages 114, 115 to position the damper plate 102 within the opening 116. To this end, the first end 109 at least partially extends into the first passage 114 and the second end 111 extends into the second passage 115. A bushing 118 receives the first end 109 of the shaft 106 and rotatably connects the shaft to the flange 112. Due to this construction, rotation of the shaft 106 about an axis 104 in the manner R (see FIG. 2) causes the damper plate 102 to rotate relative to the opening 116. The damper plate 102 has the same shape and size as the opening 116. A fluid-tight seal 119 is provided between the first end 109 of the shaft 106 and the hushing 118.

Figure 4:
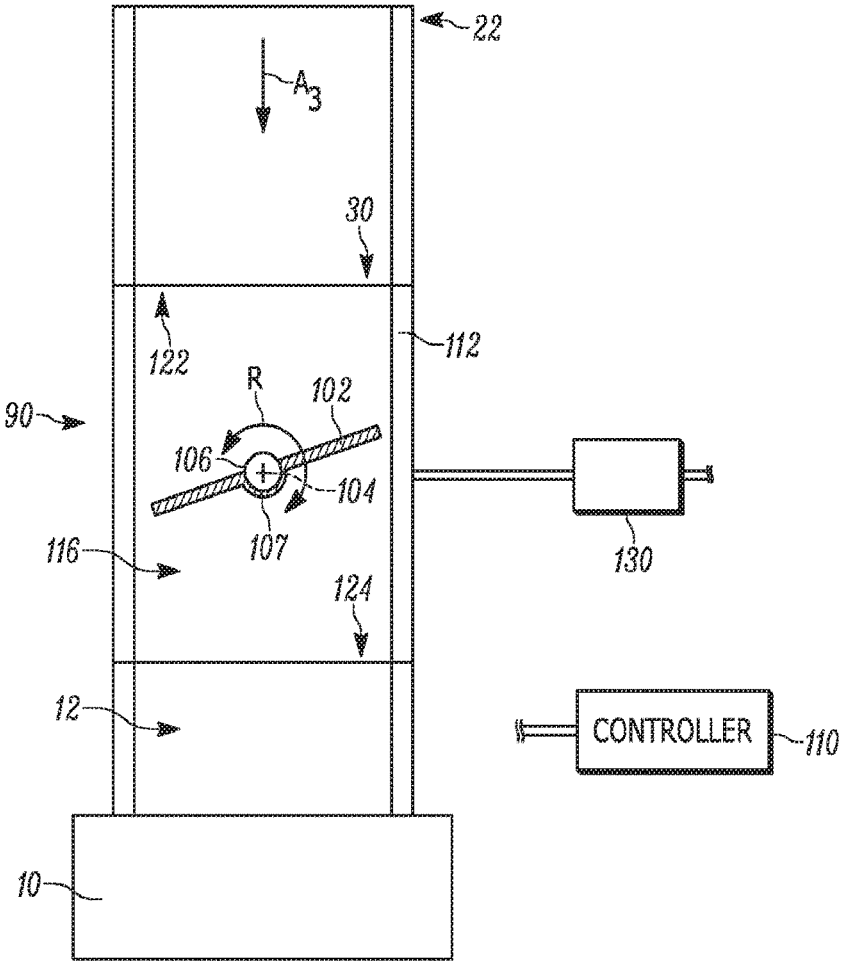
FIG. 4 is a top view of a damper of the flow control device of FIG. 1 in a first restriction position.

Referring to FIG. 4, the flow control device 90 is positioned between the blower 22 and burner 10 such that the first, inlet end 122 of the flange 112 is fluidly connected to the blower discharge opening 30. The second, outlet end 124 of the flange 112 is fluidly connected to an inlet 12 of the burner 10. The opening 116 fluidly connects the first and second ends 122, 124 of the flange 112 and therefore fluidly connects the discharge opening 30 with the inlet 12.

The damper plate 102 provided in the opening 116 is rotatable about the axis 104 in the manner R to control fluid flow through the opening and therefore control fluid flow between the blower 22 and burner 10. Consequently, the damper plate 102 can be rotated in the manner R to control the resistance to flow of the pre mixed mixture $A_3$ from the blower 22 to the burner 10.

Figure 5:
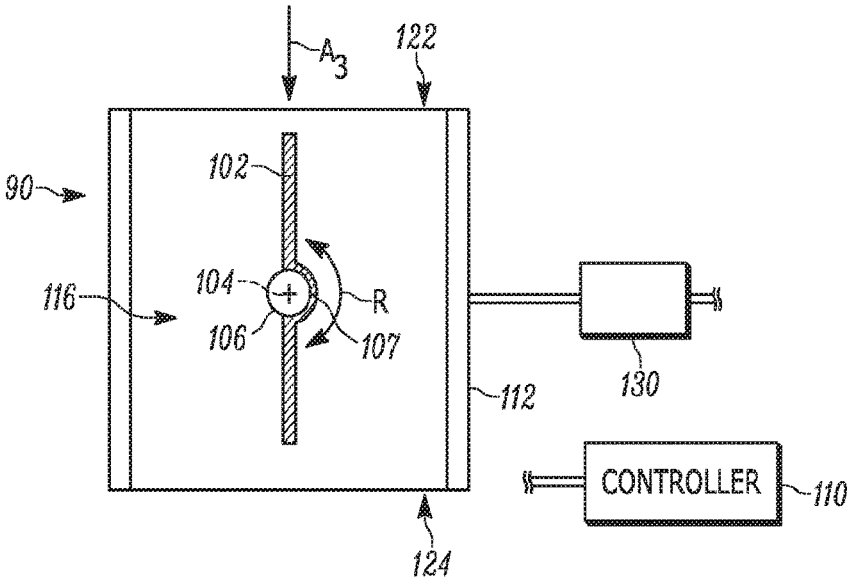
FIG. 5 is a top view of a damper plate of the flow control device of FIG. 1 in a second restriction position.

For example, positioning the damper plate 102 in a first, more horizontal position (as shown in FIG. 4) substantially perpendicular to the incoming pre-mixed mixture $A_1$ will provide a first, greater amount of resistance to fluid flow through the opening 116. On the other hand, positioning the damper plate 102 in a second, more vertical position (see FIG. 5) closer to an aligned relationship with the incoming pre-mixed mixture $A_1$ will provide a second, lesser amount of resistance to fluid flow through the opening 116. It will be appreciated that the damper plate 102 can be positioned in any rotational position relative to the incoming pre-mixed mixture $A_3$. It will also be appreciated that the flow control device 90 can be configured to operate solely at either the first position or the second position there are no fixed rotational positions therebetween.

An actuator 130 is connected to the shall 106 for controlling the rotational position thereof and thereby controls the rotational position of the damper plate 102. As a result, the actuator 130 controls the degree to which the damper plate 102 obstructs fluid flow through the opening 116. The actuator 130 can be, for example, a solenoid, stepper motor, gear motor or the like. The actuator 130 is Connected to the controller 110 for precisely controlling the actuator in order to rotate R the damper plate 102 to the desired position. The controller 110 can also be connected to sensors (not shown) positioned in the blower discharge opening 30 and/or burner inlet 12 to monitor the system conditions and adjust the rotational position of the damping member 102 accordingly.

During appliance 20 operation, the controller 110 actuates the blower 22 to draw air $A_2$ into the intake opening 28. The controller 110 also actuates the gas valve 40 such that gas $A_3$ flows into the blower 22 and mixes with the air $A_2$ to form the pre-mixed mixture of air and fuel. The pre-mixed mixture $A_1$ passes through the discharge opening 30 and into the flow control device 90.

Prior to attempting ignition of the burner 10, the controller 110 actuates the damper plate 102 to close down (rotate, tilt and/or displace) to the first pre-set or predetermined restriction position (FIG. 4). The first restriction position is configured to allow the air or air/gas mixture $A_1$ to flow through the opening 116 at a first, relatively reduced rate. This first flow restriction position increases the static fluid pressure at the blower discharge opening 30 upstream of the damper plate 102 and also reduces the air volume being delivered to the burner 10.

The first flow restriction position also causes an increase in pressure at the inlet opening 28 of the blower 22 (less negative), which lowers the gas input rate in neg reg systems. A lower gas rate to the burner 10, in combination with a higher static pressure at the blower discharge opening 30, helps eliminate or reduce the appliance 20 noise during burner 10 ignition by preventing the aforementioned pressure oscillations that normally occur. By maintaining a single, higher blower 22 speed and increased blower discharge opening 30 pressure while reducing the gas rate to the burner 10, the flow control device 90 of the present invention is advantageous over existing burner systems, which reduce both the blower speed and the gas flow prior to ignition, leading to the aforementioned ignition noise issue.

Figure 6:
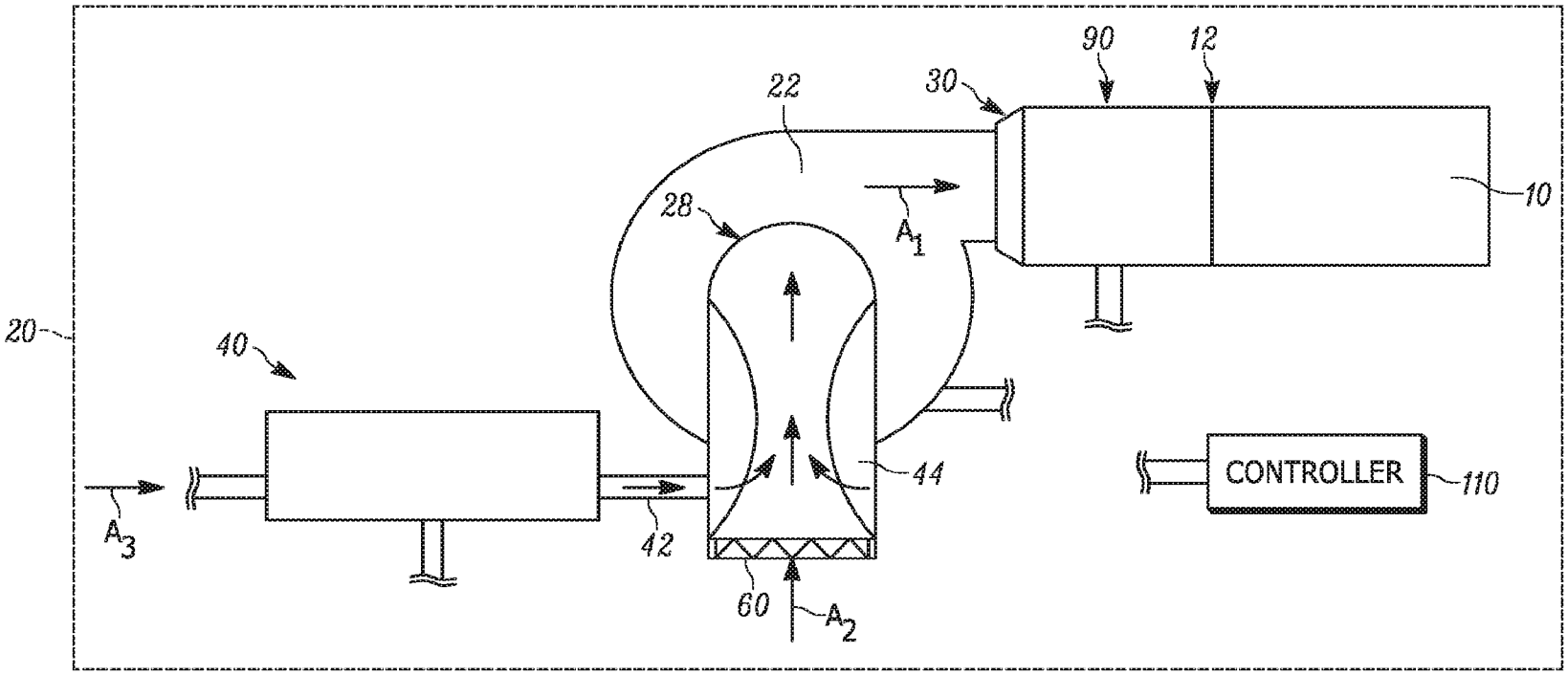
FIG. 6 is a schematic illustration of another example appliance with a burner and flow control device.

It will be appreciated that some appliances 20 can include blower inlet dampers 60 (see FIG. 6). In such configurations, the blower 22 runs at higher [constant] speeds but the pressure at the discharge opening 30 and upstream of the flow control device 90 are reduced compared to when the inlet damper 60 is absent. That said, the blower inlet damper 60 and damper plate 102 are configured to ensure that the reduced pressure at the discharge opening 30 and upstream of the flow control device 90 is sufficient to prevent blowback from the burner 10 into the blower 22 dining burner ignition.

Once the burner 10 is lit and running—which can be established with a flame-proving device—the controller 110 controls the actuator 130 to open the damping member 102 to the second preset or predetermined restriction position (FIG. 5) allowing the pre-mixed mixture $A_3$ to flow through the opening 116 at the second rate greater than the first rate. The second flow rate is facilitated by the built-up static pressure behind the damper plate 102 as well as the blower 22 continuing to run at full speed, i.e., no speed-up is necessary. The damper plate 102 can be controlled during normal operation of the appliance 20 to control the burner 10 rate.

It will be appreciated that the flow control device 90 can be configured such that the first position is substantially closed and the second position is fully open to maximize flow through the opening 116. The controller 110 can rely on the flame-proving device to switch the damping member 102 between positions. In this two-position scenario, the actuator 106 used could be a simple, two-position actuator that toggles between the two positions in response to controller 110.

Systems that control gas and air separately would work in the same way except that the gas would be turned down to an appropriate rate by the controller 110. Alternatively, the air $A_2$ could be restricted with the gas left at full rate to provide a richer mixture for ignition. Rich mixtures light easier and smoother than lean mixtures, in addition to the benefits of increased blower discharge opening 30 static pressure. This system could also be used for modulating the input 12 to the burner 10 without the need to change the blower 22 speed and while preventing unwanted burner ignition noise.

What have been described above, are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A flow control device for an appliance including a burner and a blower for delivering a pre-mixed mixture of air and gas to the burner, comprising:

a flange defining an opening through which the pre-mixed mixture of air and gas flows from an outlet of the blower to the burner; and a damper plate provided in the opening downstream of the blower with the entirety of the pre-mixed mixture flowing around the perimeter of the damper plate for controlling the flow of the pre-mixed mixture through the opening to increase a static pressure at the outlet of the blower during ignition of the burner.

2. The flow control device of claim 1 further comprising an actuator for controlling a rotational position of the damper plate relative to the flange for controlling fluid flow from the blower to the burner.

3. The flow control device of claim 2, wherein the actuator is one of a solenoid, a stepper motor or a gear motor.

4. The flow control device of claim 1 further comprising a shaft extending through at least one passage in the flange and rotatably supporting the damper plate for movement relative to the opening.

5. The flow control device of claim 1, wherein the flange is integrally formed as part of one of the outlet of the blower or an inlet of the burner.

6. The flow control device of claim 1, wherein the flange is secured to an outlet of the blower and an inlet of the burner.

7. The flow control device of claim 1, wherein the damper plate has the same shape as the opening.

8. A flow control device for an appliance including a burner and a blower for delivering a pre-mixed mixture of air and gas to the burner, comprising:

a flange defining an opening through which the pre-mixed mixture of air and gas flows from an outlet of the blower to the burner;

a damper plate provided in the opening downstream of the blower for controlling the flow of the pre-mixed mixture through the opening to increase a static pressure at the outlet of the blower during ignition of the burner;

a shaft connected to the damper plate and extending through first and second passages in the flange on opposite sides of the opening; and a bushing received in the first passage for rotatably supporting the shaft to allow the shaft to rotate relative to the opening.

9. A system for an appliance comprising:

a burner for providing heated combustion products to the appliance;

a blower having an outlet for supplying the burner with a pre-mixed mixture of gas and air; and an adjustable damper plate positioned downstream of the blower for controlling the flow of the pre-mixed mixture from the blower to the burner, the adjustable damper plate having a first condition during ignition of the burner for increasing the static pressure at the blower outlet and a second condition in response to flame proving for increasing the flow of the pre-mixed mixture to the burner relative to the first condition.

10. The system of claim 9, wherein the damper plate is adjustable such that the blower is operated at the same speed prior to and after ignition of the burner.

11. The system of claim 9 further comprising an actuator for controlling a rotational position of the damper plate to control fluid flow from the blower to the burner.

12. The system of claim 11, wherein the actuator is one of a solenoid, a stepper motor or a gear motor.

13. The system of claim 9 further comprising a flange positioned between the blower and the burner and having an opening in fluid communication with the outlet of the blower and an input of the burner, the damper plate being rotatable within and relative to the opening.

14. The system of claim 13 further comprising a shaft extending through at least one passage in the flange and rotatably supporting the damper plate for movement relative to the opening.

15. The system of claim 13, wherein the flange is integrally formed as part of one of the outlet of the blower or an inlet of the burner.

16. The system of claim 13, wherein the damper plate has the same shape as the opening.

17. The system of claim 13 further comprising:

a flange positioned between the blower and the burner and having an opening in fluid communication with the outlet of the blower and an input of the burner;

a shaft connected to the damper plate and extending through first and second passages in the flange on opposite sides of the opening; and a bushing received in the first passage for rotatably supporting the shaft to allow the shaft to rotate relative to the opening.

18. The system of claim 9, wherein in the first position the damper plate prevents pressure oscillations in the burner.

19. The flow control device of claim 1, wherein the damper plate increases the static pressure at the blower outlet to prevent pressure oscillations in the burner.

20. The flow control device of claim 8, further comprising a fluid-tight seal positioned between and engaging the shaft and the bushing.

21. The flow control device of claim 9, wherein in the first condition during ignition the damper plate allows a non-zero amount of flow of the pre-mixed mixture past the damper plate to the burner.

* * * * *